US012529539B2

(12) United States Patent
Casadio

(10) Patent No.: US 12,529,539 B2
(45) Date of Patent: Jan. 20, 2026

(54) INTEGRALLY SUPPRESSED BARREL SYSTEM FOR VELOCITY REDUCTION OF LOADS

(71) Applicant: Nicolas Joseph Casadio, Austin, TX (US)

(72) Inventor: Nicolas Joseph Casadio, Austin, TX (US)

( * ) Notice: Subject to any disclaimer, the term of this patent is extended or adjusted under 35 U.S.C. 154(b) by 0 days.

(21) Appl. No.: 18/893,559

(22) Filed: Sep. 23, 2024

(65) Prior Publication Data

US 2025/0109921 A1 Apr. 3, 2025

Related U.S. Application Data

(60) Provisional application No. 63/586,995, filed on Sep. 29, 2023.

(51) Int. Cl.
*F41A 21/30* (2006.01)
*F41A 5/26* (2006.01)

(52) U.S. Cl.
CPC ..... *F41A 21/30* (2013.01); *F41A 5/26* (2013.01)

(58) Field of Classification Search
CPC ..... F41A 5/18; F41A 5/20; F41A 5/22; F41A 5/24; F41A 5/26; F41A 5/28; F41A 21/30; F41A 21/32; F41A 21/325
See application file for complete search history.

(56) References Cited

U.S. PATENT DOCUMENTS

| | | | | |
|---|---|---|---|---|
| 812,140 | A | 2/1906 | Kent | |
| 4,173,186 | A | 11/1979 | Dunham | |
| 4,291,610 | A * | 9/1981 | Waiser | F41A 21/30 89/14.4 |
| 4,501,189 | A | 2/1985 | Brandl et al. | |
| 5,844,162 | A | 12/1998 | Renner | |
| 6,324,780 | B1 | 12/2001 | Behling | |
| 8,061,260 | B2 | 11/2011 | Kenney et al. | |
| 9,103,618 | B2 | 8/2015 | Daniel et al. | |
| 9,261,314 | B1 * | 2/2016 | Jackson | F41A 5/26 |
| 10,234,231 | B2 | 3/2019 | Gianelloni, III et al. | |
| 10,697,726 | B2 | 6/2020 | Gomez | |
| 10,809,033 | B2 | 10/2020 | Tindal | |
| 11,162,754 | B2 | 11/2021 | Heckenlively | |
| 2003/0024377 | A1 | 2/2003 | Diller | |
| 2013/0291713 | A1 * | 11/2013 | Zheng | F41A 5/28 89/191.02 |

(Continued)

OTHER PUBLICATIONS

"A Guide to the Identification of Small Arms and Light Weapons", Weapons Identification : Small Arms,Jan. 14, 2019, 130 pages.

*Primary Examiner* — Bret Hayes

(74) *Attorney, Agent, or Firm* — Spencer Fane, LLP

(57) ABSTRACT

An integrally suppressed barrel system for a firearm, the system comprises a barrel having a series of transverse holes and a spiral groove forming machine-type threads of some dimension or specification, a gas block assembly configured to provide integration with the gas cycling system inherent to a firearm, a gas tube configured to protrude back into an upper receiver of the firearm, and a suppressor having a main housing. The main housing of the suppressor includes an inner wall, an outer wall, a series of holes and a base attached to the barrel through machine threads. The suppressor is fixed in a concentric pattern about the bore of the barrel.

15 Claims, 6 Drawing Sheets

(56) References Cited

U.S. PATENT DOCUMENTS

| | | | | |
|---|---|---|---|---|
| 2015/0001001 | A1* | 1/2015 | Wilson | F41A 21/36<br>219/76.1 |
| 2015/0090105 | A1* | 4/2015 | Pace | F41A 21/30<br>89/14.4 |
| 2018/0202744 | A1* | 7/2018 | De Sousa | F41A 21/30 |
| 2018/0238653 | A1* | 8/2018 | Kunsky | F41A 21/30 |
| 2020/0025498 | A1* | 1/2020 | Wheeler | F41A 21/325 |

* cited by examiner

INTEGRALLY SUPPRESSED BARREL SYSTEM FOR VELOCITY REDUCTION OF LOADS

CROSS REFERENCE TO RELATED APPLICATIONS

This application claims priority to U.S. Provisional Patent Application No. 63/586,995 filed on Sep. 29, 2023, entitled "AN INTEGRALLY SUPPRESSED BARREL SYSTEM FOR VELOCITY REDUCTION OF LOADS," the content of which is incorporated by reference herein in its entirety.

FIELD OF INVENTION

The present invention relates to the field of firearm suppressors and in particular relates to an integrally suppressed barrel system for velocity reduction of supersonic to subsonic loads and suppression of report of muzzle blast to below OSHA (The US Occupational Safety and Health Administration) hearing safe levels.

BACKGROUND OF THE INVENTION

A firearm suppressor is a well-known device used to reduce the sound produced when a projectile, such as a bullet, is fired through the barrel of a firearm. Sound is produced by firearms typically for three reasons: (i) the rapid expansion of gasses as the projectile leaves the barrel; (ii) the supersonic crack that the projectile makes as it accelerates past the speed of sound; and (iii) the energy dissipation as hot propellant gasses meet ambient-temperature air. Most suppressors work by regulating the flow of the propellant gases that follow the projectile as it exits from the muzzle end of the firearm. By dissipating the pressure exerted by the propellant gas on the surrounding atmosphere, the amount of sound produced is significantly reduced.

One way to dissipate the gases generated by a firearm is by using a baffle-based suppressor having multiple chambers that allow the partial expansion of gasses for the purpose of noise cancellation. The baffle system can have different designs, such as a stacked baffle, monocores and more.

Additionally, the suppressors can be integrally connected to the firearm's barrel through methods such as screws or welding. Alternatively, they can be made detachable via a threaded connection or other mechanical means. Integrating a suppressor with the barrel mitigates several adverse effects that impact the firearm's operability, such as muzzle blast/flash. The gases released from a fired cartridge may also cause discomfort for the user of the firearm; for example, the muzzle blast can also cause hearing impairment while muzzle flash can affect vision.

Thermal insulation of the muzzle is a persistent issue in suppressor design that affects its performance as seen in conventional integral designs. Muzzle flashes, for example, can produce temperatures nearing 5000 degrees Fahrenheit, which necessitates effective heat control to avoid "suppressor meltdown" in certain firearms, such as a machine gun. Muzzle heating is also a significant issue for the average firearm user, who can sustain serious burn injuries upon contacting an outer housing of a heated suppressor. To address this issue, some suppressor designs include an insulated pad or "oven mitt" with their product, while others provide insulated sleeves that wrap around the suppressor. However, there is a need for more effective ways of heat insulation.

Certain pistol caliber automatic firearm designs, such as the Heckler & Koch MP5-SD, utilize an integral suppression technology, but with a delayed blowback system for pistol caliber ammunition. This type is relatively low velocity, yet still supersonic. Conversely, conventional integrally suppressed rifle caliber systems focus solely on sound suppression without velocity reduction and are generally designed as a specific pairing of a rifle and suppressor. Additionally, existing firearms often require extra components to overcome the drawbacks of conventional firearm and suppressor designs resulting in heavy and bulky overall handling.

Other conventional art discloses locking devices that comprise a rotatable sleeve for hand-held firearms, which selectively block the path of the expanding gas from projectile fire. The disclosed locking device provides a user with a choice between the use of a high degree of silencing (elimination of muzzle blast and sonic boom from bullet velocity) and a low degree of silencing (elimination of only the muzzle blast) in a single hand-held firearm. Further, such devices can introduce additional complexity to the operation of a firearm. Further, their engaging and disengaging could be time-consuming and reliability is also a major concern in addition to their weight, compatibility and cost issues.

Thus, there remains an unmet need to provide an integrally suppressed barrel system for not only the suppression of muzzle blast report but also the conversion of normally supersonic ammunition to perform subsonically, i.e., having a velocity<1125 ft/sec, which would reduce or eliminate the sounds produced by the supersonic wave of the bullet as it travels through the air. There is a further need to improve the form factor of the overall suppressor system in a direct-impingement gas-cycling, automatic firearm, which may reduce the weight and space required by the firearm.

There is an even further unmet need for a suppressor system that helps effective heat insulation and reduces the chance of sustaining serious burn injuries.

SUMMARY

The present invention provides a suppressor system for a firearm for reducing the velocity of supersonic loads to subsonic loads and the suppression of report. The present disclosure of the invention not only meets the above-outlined needs but also allows for the use of economic, readily available, supersonic rifle caliber ammunition.

In an embodiment, the suppressor system includes a barrel having a connecting end and a muzzle end, wherein the barrel includes a series of transverse holes along its bore, wherein the barrel is configured to be attached to an upper receiver of the firearm at the connecting end, a gas block assembly, wherein the gas block assembly is attached to an outer peripheral surface on a base of the barrel, proximal to the connecting end, a pressure retainer attached to the barrel at the muzzle end, a suppressor housing configured to envelope the barrel, forming an enclosed chamber between the barrel, the gas block assembly, the pressure retainer and the suppressor housing, and a gas tube attached to the gas block assembly, wherein the gas tube protrudes back into the upper receiver of the firearm.

In an embodiment, the gas block assembly comprises a removable base cup configured to rest on a circular shoulder of the barrel, and a gas block cap configured to secure the removable base cup onto the barrel, wherein the removable base cup and the gas block cap form a pressure chamber therebetween.

In an embodiment, the removable base cup is configured to slip-fit on the circular shoulder on the base of the barrel.

In an embodiment, the gas block cap comprises internal threads, and is configured to fasten onto a complementarily threaded portion of the base of the barrel.

In an embodiment, the series of transverse holes about the bore of the barrel connects the pressure chamber parallel to the bore of the barrel, wherein the gas block assembly is integrated into the suppressor mount assembly via the removable base cup.

In an embodiment, the suppressor housing is a double-walled housing, comprising an inner housing wall and an outer housing wall attached concentrically with each other along a bore axis of the barrel.

In an embodiment, a suppressor mount assembly is configured to attach to the barrel of the firearm, wherein the suppressor is affixed to the barrel in a concentric pattern about a bore of the barrel through the suppressor mount assembly.

In an embodiment, the removable base cup is located radially in a position by way of a locating pin and notch feature formed into the outer peripheral surface of the barrel, opposite the gas tube and just forward of a barrel chamber.

In an embodiment, the gas block cap is a pressure transfer cap.

In an embodiment, the pressure retainer is located towards the muzzle end of the barrel and is concentric to an inner housing wall of the suppressor housing assembly.

In an embodiment, a monocore baffle is attached to the muzzle end of the barrel.

In an embodiment, between the suppressor outer housing wall and the suppressor inner housing wall, a gap is created that contains air, gas or a combination of insulating materials.

In an embodiment, the gas block cap is mechanically affixed to inner and outer housing walls of the suppressor housing assembly as a structurally supportive feature.

In an embodiment, the circular shoulder is a smaller diameter concentric circular portion slightly fore and almost coplanar to a barrel nut and offset from a muzzle of the barrel.

In an embodiment, the gas block cap comprises a series of holes radially arrayed about a bore axis of the barrel and equidistant from each other.

In an embodiment, the gas block cap has an outermost diameter equal to that of the removable base cup, a first concentric shoulder equal to an internal diameter of the suppressor outer housing wall, and a second concentric shoulder equal to an internal diameter of the suppressor inner housing wall, wherein the suppressor inner and outer housing walls are connected to the gas block cap by means of a slip fit mating into the first and second concentric shoulders, respectively.

BRIEF DESCRIPTION OF INVENTION AND DRAWINGS

For a fuller understanding of the invention, reference should be made to the following detailed description, taken in connection with the accompanying drawings, in which.

DETAILED DESCRIPTION OF THE INVENTION

In the following detailed description of the preferred embodiments, reference is made to the accompanying drawings, which form a part thereof, and within which are shown by way of illustration-specific embodiments by which the disclosure may be practiced. It is to be understood that other embodiments may be utilized, and structural changes may be made without departing from the scope of the disclosure.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

Exemplary embodiments will be described in detail below with reference to the accompanying drawings, which show some of the embodiments. This disclosure may, however, be embodied in many different forms and should not be construed as limited to the embodiments set forth herein. However, it should be understood that the present disclosure may be implemented in various forms and is not limited to the embodiments described herein. These embodiments are presented to ensure that the disclosure is complete and to convey the scope of the disclosure to those skilled in the art. Furthermore, all statements describing embodiments of the disclosure, as well as specific examples thereof, are intended to cover both structural and functional equivalents. Such equivalents may include currently known equivalents as well as equivalents that may be developed in the future (i.e., any elements that perform the same function, regardless of their structure).

One or more of the problems of the conventional prior art may be overcome by various embodiments of the present disclosure. The disclosure accordingly comprises the features of construction, combination of elements, and arrangement of parts that will be exemplified in the disclosure set forth hereinafter and the scope of the disclosure will be indicated in the claims.

Various terms as used herein are shown below. To the extent a term used in a claim is not defined below, it should be given the broadest definition as persons in the pertinent art have given that term as reflected in printed publications and issued patents at the time of filing.

Figure 1:
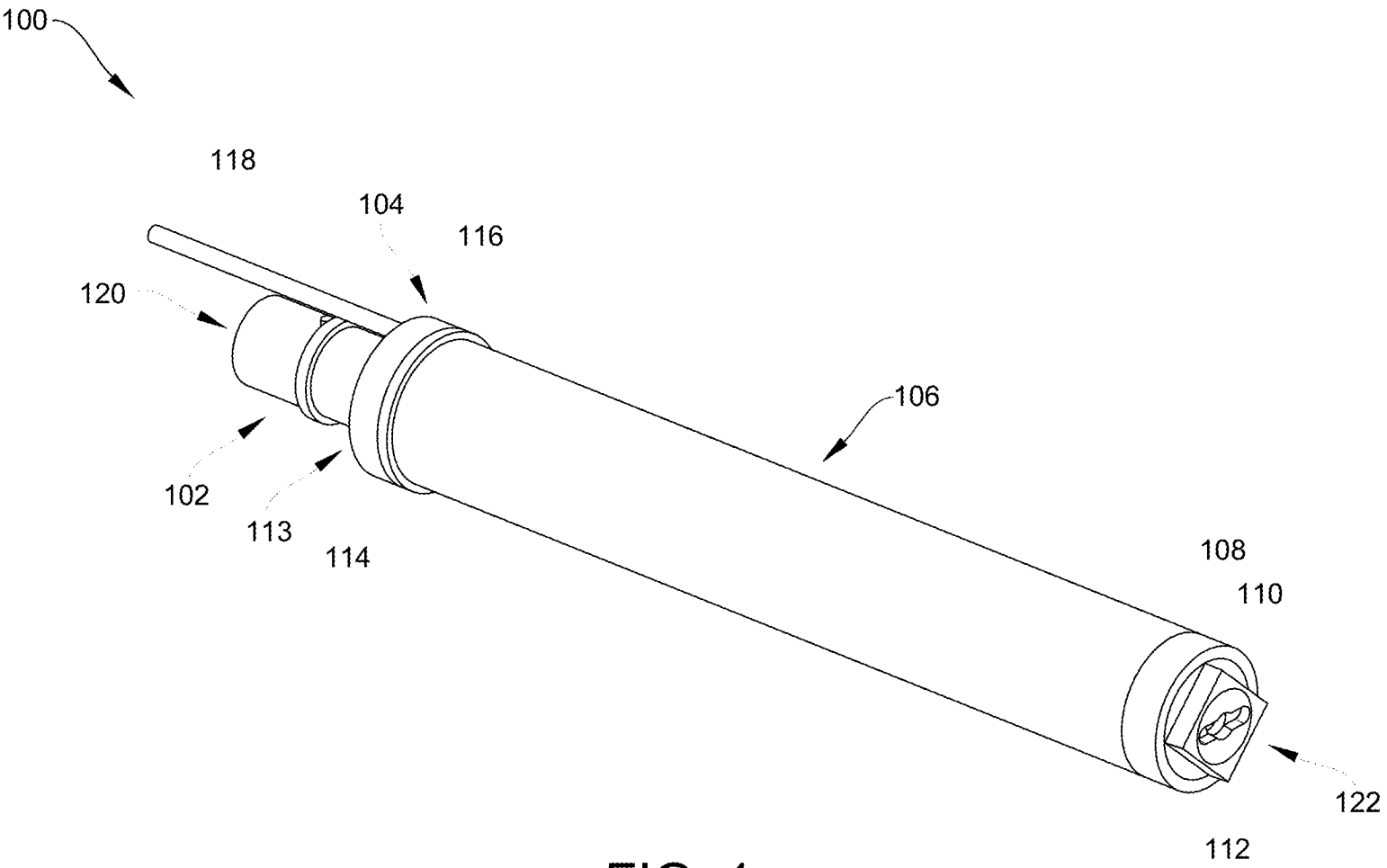
FIG. 1 illustrates a perspective view of an integral suppressor system for a firearm, in accordance with an embodiment of the present invention.

FIG. 1 illustrates a perspective view of an integral suppressor system 100 for a firearm, in accordance with an embodiment of the present invention. The integral suppressor system 100 can be attached to an upper receiver (not shown in the figure) of the firearm. In an aspect of the invention, the firearm may be selected from any number of firearms such as, but not limited to, an M-16 style rifle, an AR-15 style rifle, an AR-10 style rifle or an M-4 style rifle, or the like. Further, the firearm selected may include both long- and short-barreled firearms.

As shown in FIG. 1, the integral suppressor system 100 comprises a barrel 102 configured with a gas block assembly 104, a suppressor housing 106, a coupling ring 108, an end cap 110 and a wipe 112. The gas block assembly 104 comprises a removable base cup 114 and a gas block cap 116 fitted on the barrel 102. Said suppressor housing 106 can be an assembly of two or more housings arranged concentric to one another, forming a suppressor housing assembly 106. In an alternative embodiment, the suppressor housing 106 may be an assembly of two or more housings arranged non-concentrically to one another, which forms the suppressor housing assembly 106. The non-concentric configuration may allow for an increase in the internal volume of the suppressor, which would improve the ability of the suppressor to suppress gases by increasing the amount of gases it may hold at one time, without raising the height of the bore axis and without creating a blockage in the line of the sights of the firearm. For example, a bottom portion of the suppressor outer housing wall 130 (described in more detail below) may be extended downward to form an oblong or similar shape of cross section, thereby increasing the volume of space between the suppressor outer housing wall 130 and inner housing wall 132. Further, a gas tube 118 is integrated into the gas block assembly 104 such that the gas tube 118 protrudes back into the upper receiver of the firearm via a rear end 113 of the removable base cup 114. In an embodiment, the integral suppressor system 100 is connected to the firearm at a proximal end or a connecting end 120 of the barrel 102, from where a bullet enters into the integral suppressor system 100 and exits from a discharge end 122. Further, the connecting end 120 is connected to the upper receiver of the firearm through any known mechanical means in the art, such as threaded means, a bolt, welds, or any similar means capable of securing the barrel 102 with the upper receiver of the firearm.

Figure 2:
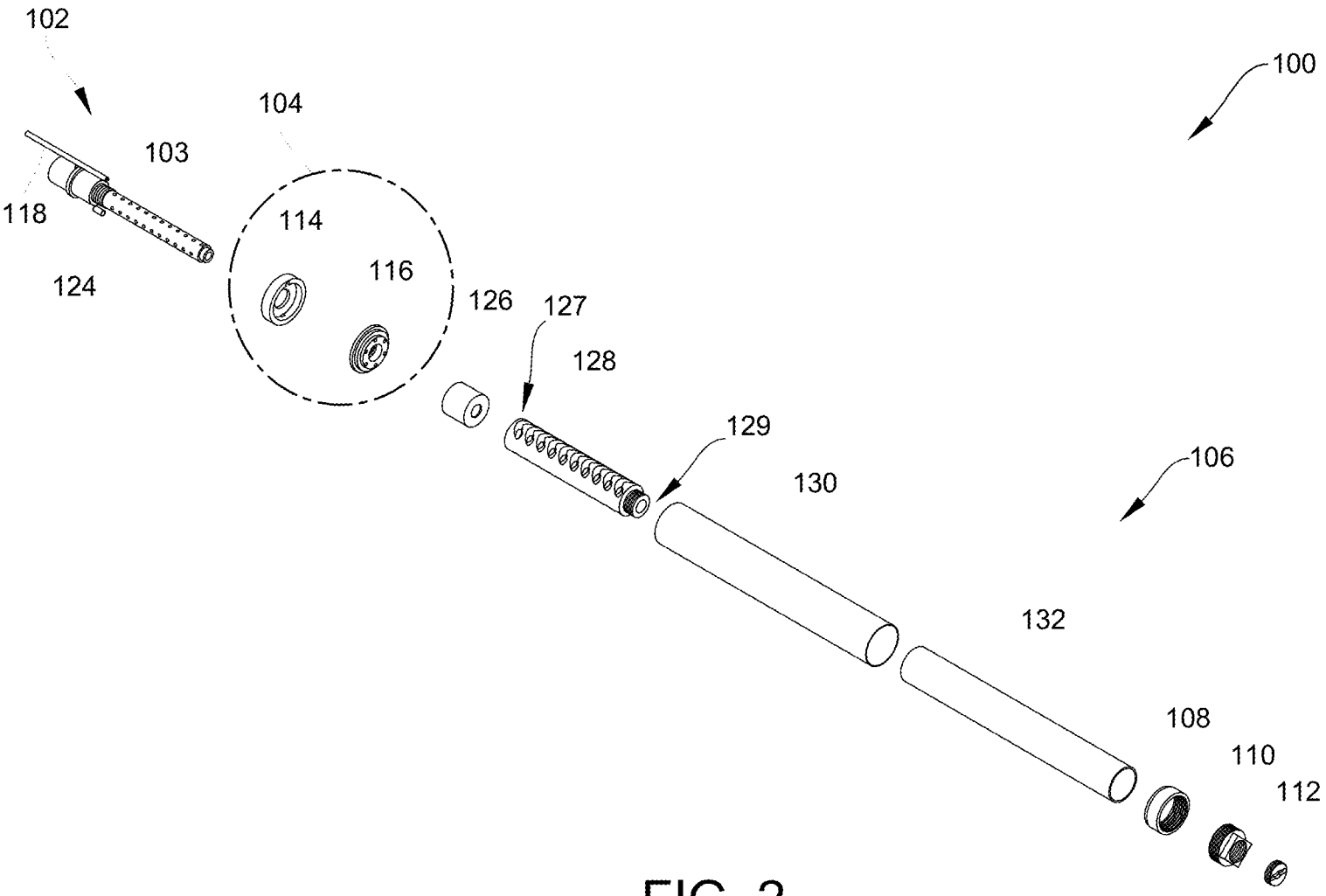
FIG. 2 illustrates an exploded view of the integral suppressor system of FIG. 1, in accordance with the present invention.

FIG. 2 illustrates an exploded view of the integral suppressor system 100 of FIG. 1, in accordance with the embodiment of the present invention. In an embodiment, the barrel 102 comprises a bore 103, commonly known as a rifled bore or simply a bore. The barrel 102, on its outer periphery, receives the gas block assembly 104 comprising the removable base cup 114 and gas block cap 116. The gas block cap 116 is internally threaded and is fastened to a threaded portion on the periphery of the barrel 102 through its internal threads to secure the removable base cup 114 onto the barrel 102. A pressure retainer 126 is attached to a distal end, i.e., a muzzle end of the barrel 102.

The integral suppressor system 100 further comprises a baffle 128, wherein the baffle 128 includes a first end 127 (e.g., an entry end) and a second end 129 (e.g., an exit end). On assembling the integral suppressor system 100, the first end 127 of the baffle 128 is attached to the muzzle end of the barrel 102 and abuts the pressure retainer 126. The baffle 128 on the second end 129 comprises a smaller diameter portion having external threads. As illustrated in FIG. 2, the baffle 128 is a monocore baffle having a single unibody assembly; however, said baffle 128 can also be a stacked baffle or the like. The suppressor housing assembly 106 is a double-walled housing, which comprises a suppressor outer wall or a suppressor outer housing tube 130 and a suppressor inner wall or a suppressor inner housing tube 132. Said double walls 130, 132 of the suppressor housing assembly 106 provide insulation from the heat emitted from the fired cartridge. Insulative materials may be provided between the double walls 103, 132 to provide the greatest possible insulative effect, as described in more detail later on.

The integral suppressor system 100 further comprises the coupling ring 108 for coupling together the suppressor outer housing wall 130 and the suppressor inner housing wall 132 of the suppressor housing 106, wherein, the suppressor housing 106 is fixed to the barrel 102 concentrically about the bore of the barrel 102 between the gas block assembly 104 and the coupling ring 108. The coupling ring 108 comprises internal threads and the end cap 110 comprises internal threads and external threads, where the external threads are configured to be fastened to the internal threads of the coupling ring 108 and the internal threads are configured to be fastened to the external threads of the smaller diameter portion of the baffle 128, securing both in the integral suppressor system 100. The wipe 112 shown here is a little cap at the discharge end 122, configured to be fastened into the end cap 110, wherein the wipe 112 helps contain gasses and sound in the integral suppressor system 100.

Figure 3:
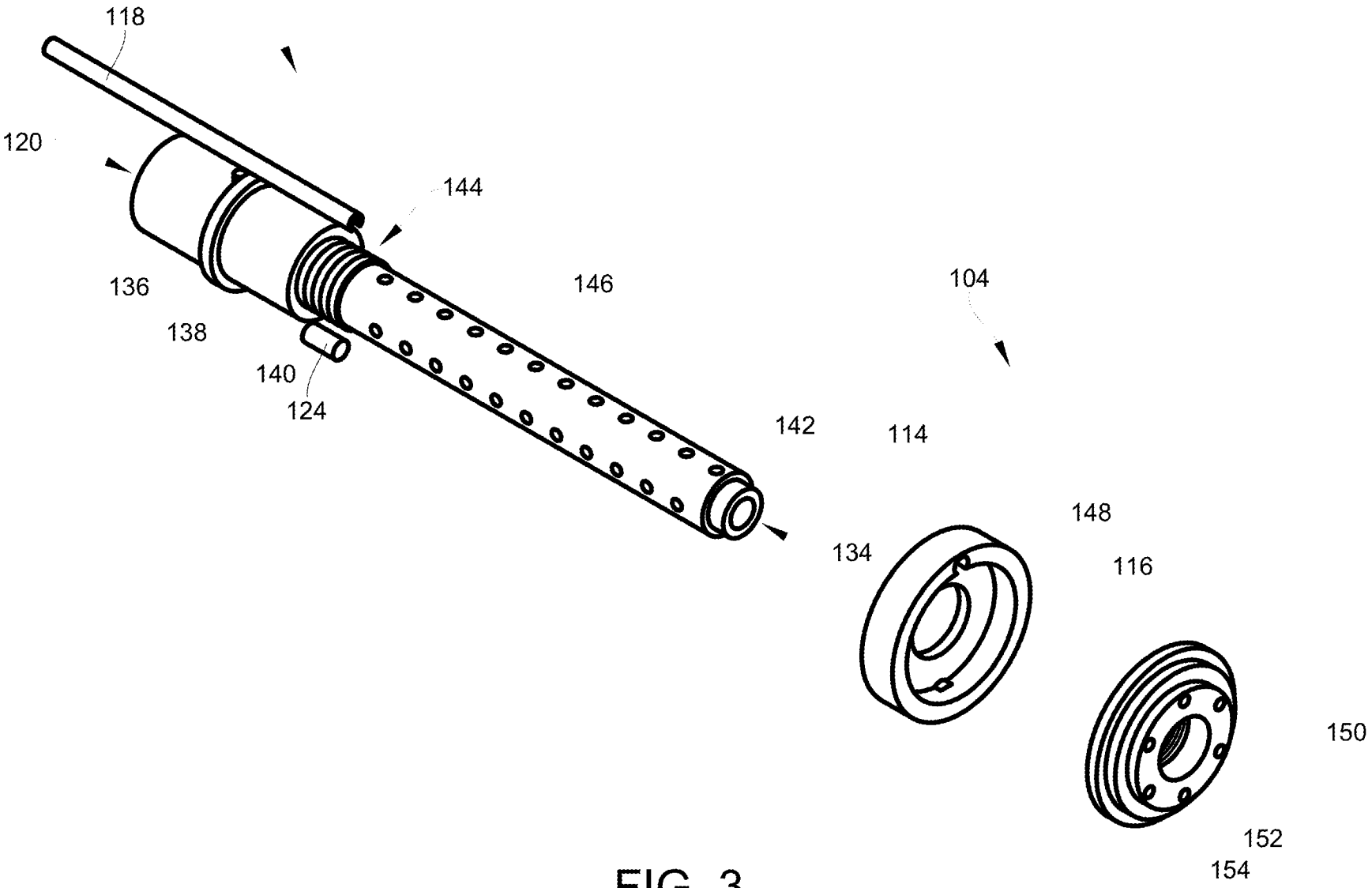
FIG. 3 illustrates a close-up view of the gas block assembly system of FIG. 2, in accordance with the present invention.

FIG. 3 illustrates a close-up view of the barrel 102 and the gas block assembly 104 of FIG. 2. The gas block assembly 104 includes the removable base cup 114, and the gas block cap 116, with the integrated gas tube 118. As shown, the barrel 102 consists of a bore that extends longitudinally from the connecting end 120 towards the distal end or muzzle end 134 of the barrel 102. At the connecting end 120, the barrel 102 comprises a barrel sleeve 136 having a barrel extension 138 for attachment of the barrel 102 with the upper receiver of the firearm, wherein said attachment is accomplished by means of a barrel nut (not shown). The barrel 102 further comprises a first circular shoulder 140 positioned slightly before and concentric and almost coplanar to the barrel extension 138 and the barrel nut, thus creating a smaller diameter portion or a base on the barrel 102 at the smaller diameter of the first circular shoulder 140. Further, the base of the barrel 102 offset on the muzzle end 134 creates a second circular shoulder 142. The barrel further comprises spiral grooves forming threaded portion 144 of predetermined dimension or specification, machined in the base of the barrel 102, close to the first circular shoulder 140, near the barrel extension 138 or barrel nut. The specific dimension of the threads of the threaded portion 144 may vary depending on the type of rifle used. Further, the bore of the barrel 102 on the base includes multiple rows or series of gas ports 146 transverse to a bore axis between the threaded portion 144 and the muzzle end 134. The gas port 146 allows expanding of gases to release out of the barrel 102 which reduces a bullet's velocity from that of supersonic loads to that of subsonic loads. In an embodiment, size and spacing between the transverse gas ports 146 may vary, and may have a shape selected from at least one of a round shape, rectangular shape, triangular shape and the like.

As shown in FIG. 3, the removable base cup 114 comprises a central hole concentric to the bore axis and equal in diameter to the base of the barrel 102. As used herein, components of equal diameter that are otherwise described relationally or as inner and outer components are able to nest, be press fit, or otherwise operably interact with each other unless otherwise stated. On assembly, the removable base cup 114 rests on the first circular shoulder 140 of the barrel 102, forming a slip-fit connection. Further, the removable base cup 114 is held radially forward of the barrel sleeve 136 in a specific position by means of a locating pin and notch 124 feature formed onto the outer surface of the barrel 102 opposite of the gas tube 118. The removable base cup 114 comprises a hole 148 configured on a radial periphery of the removable base cup 114 for allowing the connection of gas tube 118.

The gas block cap 116 is internally threaded and configured to be fastened onto the threaded portion 144 of the barrel 102. The gas block cap 116 comprises a series of holes 150 radially arrayed about the bore axis and equidistant to each other. In an alternative embodiment, the series of holes 150 are not equidistant to each other. In another embodiment, gas block cap 116 comprises an outermost diameter equal to that of the removable base cup 114 and a first concentric shoulder 154 equal to the internal diameter of the suppressor outer housing wall 130, and a second concentric shoulder 152 equal to the internal diameter of the suppressor inner housing wall 132, wherein the suppressor inner and outer housing walls 130, 132 are connected to the gas block cap 116 by means of a slip fit mating onto the first and second concentric shoulders 154, 152 respectively. The gas block cap 116 is permanently or resiliently affixed to the inner and outer walls of the suppressor outer housing wall 130 and the suppressor inner housing wall 132 of the suppressor housing 106 as a structurally supportive feature of the overall design.

The gas tube 118 on assembled integral suppressor system 100 protrudes back into the upper receiver of the firearm via a rear of the removable base cup 114 of the gas block assembly 104, wherein the gas tube 118 is press-fitted, drilled, pinned or secured by some mechanical means and extends longitudinally the entire length of the hole 148 of the removable base cup 114 and into the upper receiver of the firearm. Gas tube 118 further comprises a slot 119 or opening along its circumference disposed toward the muzzle end 134. The slot 119 of the gas tube 118 does not protrude toward the connecting end 120 further than the hole 148 does. Further, the slot 119 of the gas tube 118 is disposed toward the base of the barrel 102. Said entire length is necessary to adequately penetrate the gas key of a bolt carrier group and meet the specification for gas tubes in gas impingement systems. Depending on the barrel nut used, the gas tube 118 may extend through the body of the barrel nut.

Figure 4:
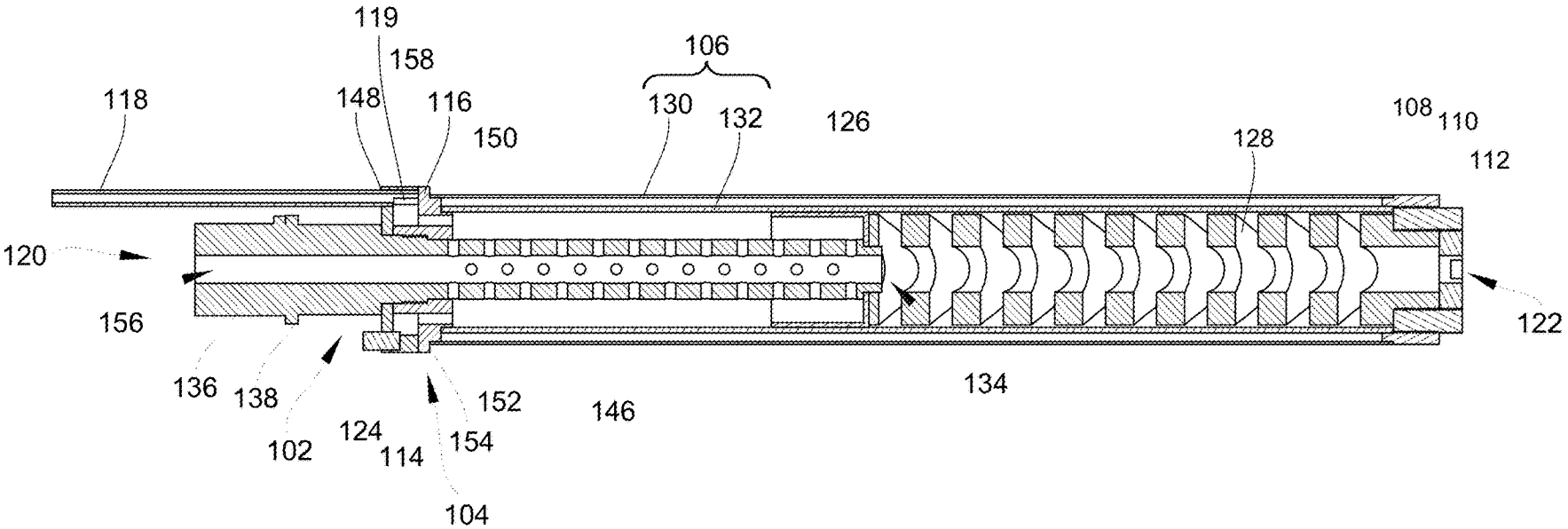
FIG. 4 illustrates a planar cross-sectional view of the integral suppressor system of FIG. 1, in accordance with the present invention.

FIG. 4 illustrates a planar cross-sectional view of the integral suppressor system of FIG. 1, in accordance with the present invention, illustrating the assembled internal components. In operation, a firearm cartridge (not shown) of appropriate caliber is loaded into a barrel chamber 156 of the barrel 102 and secured by the action of a bolt carrier group (BCG), whereas, discharge of the cartridge is controlled by a fire control group (FCG). On firing, a projectile of the cartridge is propelled from its casing and the barrel chamber 156 and moved through the bore of the barrel 102 and through the baffle 128 and exits the discharge end 122 of the integral suppressor system 100. The expanding gasses of the cartridge flow out of the transverse rows of gas ports 146 of the barrel 102, building pressure in the suppressor inner housing wall 132 in a region defined between the gas block assembly 104, the base of the barrel 102 comprising the gas ports 146, the suppressor inner housing wall 132 and the pressure retainer 126 toward the muzzle of the barrel 134. The pressurized expanding gasses flow aft through the radially distributed holes 150 of the gas block cap 116, which are parallel to the bore axis of the barrel 102, thereby building pressure in a pressure chamber 158 formed between the removable base cup 114 and the gas block cap 116. This built-up pressure in the pressure chamber 158 forces the expanding gasses to flow through the gas tube 118, back into the upper receiver of the firearm, which triggers the bolt carrier group (BCG), initiating an automatic cycling of loading, and securing the appropriate caliber into the barrel chamber 156 of the barrel 102. Hence, the compressed gasses not only vent out of the transverse rows of gas port 146 of the barrel 102 for the sake of reducing the velocity of the projectile, for reduction of the audible sound, but also is transferred into the parts of the firearm for the operation of a gas cycling system that allows automatic cycling of loading and securing the appropriate caliber into the barrel chamber 156 of the barrel 102.

As shown in FIG. 4, the suppressor housing assembly 106 comprising the suppressor outer housing wall 130 and the suppressor inner housing wall 132 is secured between the gas block cap 116 and the coupling ring 108 and end cap 110.

In an embodiment, the gas block cap 116 is mechanically affixed to the suppressor outer housing wall 130 and the suppressor inner housing wall 132 as a structurally supportive feature of the overall design. In an embodiment, the gap between the suppressor outer housing wall 130 and the suppressor inner housing wall 132 may contain air, gas, insulating foam, silicone, or another insulative material, or may contain some combination of these or other insulative materials. The gas tube 118 protrudes back into the upper receiver of the firearm via the gas block cap 116, and is supported by the barrel nut. The gas tube 118 is configured to be of adequate length necessary to penetrate a gas key of the bolt carrier group (BCG) and meet AR15 military specifications for gas tubes of gas impingement systems. In an embodiment, the gas tube 118 is adapted to press-fit into the hole 148 of the removable base cup 114.

Figure 5A:
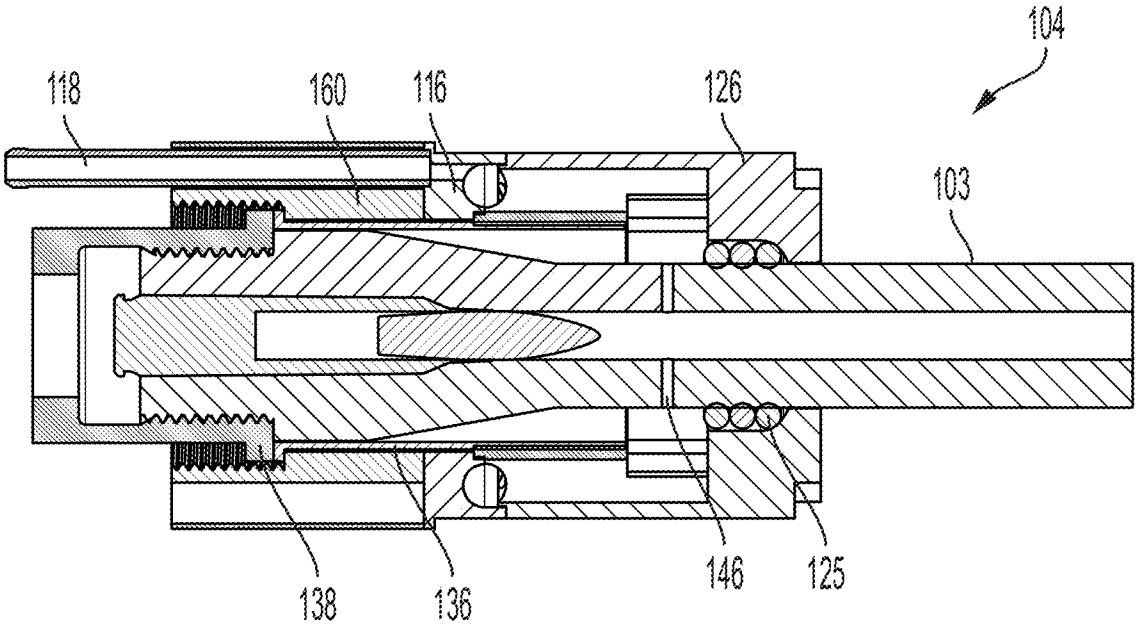
FIG. 5A illustrates a planar cross-sectional view of a different embodiment of the gas block assembly system of FIG. 3, in accordance with the present invention.
Figure 5B:
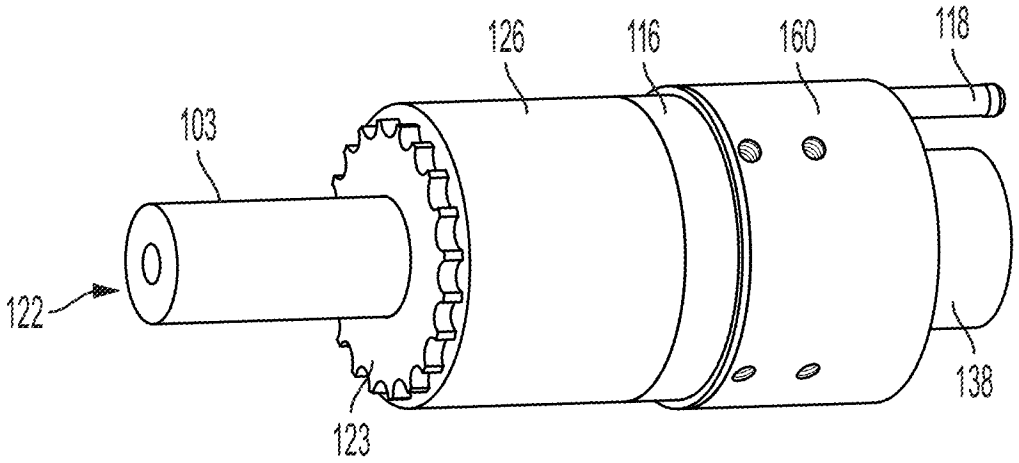
FIG. 5B illustrates a perspective view of the embodiment of the gas block assembly of FIG. 5A, in accordance with the present invention.

FIGS. 5A and 5B illustrate an alternative embodiment of the gas block assembly 104. The gas block assembly 104 in this embodiment is configured to have the shortest possible length while ensuring proper operation of the gas block assembly 104. In this embodiment, the gas block assembly 104 utilizes only a single row of gas ports 146 for venting of the compressed gases and for transferring of compressed gases through the gas tube 118 for the operation of the gas cycling system. This configuration allows for the gas block assembly 104 to be utilized as a standalone feature without an attached suppressor housing on a free float barrel of any length.

As shown in FIG. 5A, the gas block assembly includes a gasket 125 on the pressure retainer 126 which is configured to interface with the bore 103 when the gas block assembly 104 is mounted. The gasket 125, in a preferred embodiment, is made of a temperature resistant material such as fluorine rubber. However, any material capable of providing a proper seal between the pressure retainer 126 and the bore 103 may be used. For example, a copper sealing washer may be utilized for the gasket 125. The gasket 125 allows for the elimination of certain threaded features in other embodiments of the gas block assembly 104 by providing a resilient mating surface between the pressure retainer 126 and the bore 103 that allows for a slip-fit between the two components. Contact between the barrel sleeve 136 and the pressure retainer 126 provides further resilience to the slip-fit mating of the pressure retainer 126. The gas block cap 116 provides a fluid pathway for the compressed gases to reach the gas tube 118. The gas tube 118 in this embodiment is disposed through a cavity the barrel nut 160.

As shown in FIG. 5B, the pressure retainer 126 in this embodiment also includes a torquing surface 123 on a surface of the pressure retainer 126 closest to the discharge end 122. The torquing surface 123 in a preferred embodiment has a profile with protrusions distributed axially about the center of the cylindrical portion of the pressure retainer 126 configured to mate with an Armalite® free float barrel nut wrench profile. The torquing surface 123 provides a convenient means of ensuring the pressure retainer 126 is properly torqued onto the barrel sleeve 136, which compresses the gas block cap 116 between the barrel nut 160 and the pressure retainer 126. This compression provides a hermetic seal for gases in the pathway created from the bore 103 through the gas tube 118. The pressure retainer 126 provides configurations for the gas block assembly 104 that utilize minimal threaded portions, which aids in case of assembly. Although the torquing surface 123 is shown with an Armalite® free float barrel nut wrench profile geometry, other configurations of wrench interface geometry could be employed to provide desired amounts of torque or pressure to the pressure retainer 126.

In alternative embodiments, the pressure retainer 126 also includes mating features which allow accessories such as a suppressor, a shroud, a handguard, or any other desired accessory to be integrated toward the discharge end 122. For example, the pressure retainer 126 could use a spring lock, a quick detach mechanism, threaded features, crow's foot wrench-shape, or other geometries or mechanisms. These features may be included around or near the torquing surface 123. In some embodiments, the torquing surface 123 is configured for use as a mating feature as well. In such an embodiment, the size of the torquing surface 123 can be enlarged or decreased as desired to operably couple with a suppressor housing or other desired accessory.

According to the present disclosure, the velocity of commonly available, supersonic rifle caliber ammunition is reduced to subsonic velocity. Further, the report of muzzle blast is reduced to below OSHA hearing safe level. Moreover, the thermal conductivity of the integral suppressor system 100 is reduced using the suppressor housing 106, which envelopes the barrel 102 to mitigate the potential for the user sustaining second-degree or worse burns. This is accomplished by the double-wall configuration which provides a layer of insulating material between the inner housing wall 132 and the outer housing wall 130, as discussed above. The choice of insulative material may be based at least on the weight added by the insulative material, the relative cost of the insulative material, the thermal insulation provided by the insulative material, and/or the sound reduction achievable by the insulative material. Furthermore, the barrel length can be reduced to less than conventional barrel lengths without compromising gas cycling reliability.

A further advantage of the present disclosure is that the design of the gas block assembly 104 permits for free float barrels of any length to be used. For example, a four inch barrel on an AR or similar rifle can be employed while also using the integral suppressor system 100. Certain design characteristics may make dimensions of the gas block assembly 104 more or less desirable, such as the length and dimensions of the handrail and barrel nut to which the system is coupled, so that operable distance is maintained between the gas block assembly 104 and the upper receiver. However, the actual length of the free float barrel available is not necessarily affected by these characteristics.

Another advantage of the present disclosure is alleviation of the financial strain of having to purchase expensive subsonic ammunition and an AR-15 style rifle chambered specifically for that ammunition and intended to be suppressed. A standard, off-the-shelf .223 Remington/5.56 NATO cartridge can be utilized for consistent subsonic performance.

The advantages set forth above, and those made apparent from the foregoing description, are attained in an effective and cost-efficient manner.

Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

I claim:

1. A suppressor system for a firearm, the suppressor system comprising:

a barrel having a connecting end and a muzzle end, wherein the barrel includes a series of transverse holes along its bore, wherein the barrel is configured to be attached to an upper receiver of the firearm at the connecting end;

a gas block assembly, wherein the gas block assembly is attached to an outer peripheral surface on a base of the barrel, proximal to the connecting end, wherein the gas block assembly comprises:

a removable base cup configured to rest on a circular shoulder of the barrel; and a gas block cap configured to secure the removable base cup onto the barrel, wherein the removable base cup and the gas block cap form a pressure chamber therebetween;

a pressure retainer attached to the barrel at the muzzle end;

a suppressor housing configured to envelope the barrel, forming an enclosed chamber between the barrel, the gas block assembly, the pressure retainer and the suppressor housing; and a gas tube attached to the gas block assembly, wherein the gas tube protrudes back into the upper receiver of the firearm.

2. The suppressor system as claimed in claim 1, wherein the removable base cup is configured to slip-fit on the circular shoulder on the base of the barrel.

3. The suppressor system as claimed in claim 1, the gas block cap comprises internal threads, and is configured to fasten onto a complementarily threaded portion of the base of the barrel.

4. The suppressor system, as claimed in claim 1, wherein the suppressor housing is a double-walled housing, comprising an inner housing wall and an outer housing wall attached concentrically with each other along a bore axis of the barrel.

5. The suppressor system as claimed in claim 4, wherein between the suppressor outer housing wall and the suppressor inner housing wall, a gap is created that contains air, gas or a combination of insulating materials.

6. The suppressor system as claimed in claim 4, wherein the gas block cap has an outermost diameter equal to that of the removable base cup, a first concentric shoulder equal to an internal diameter of the suppressor outer housing wall, and a second concentric shoulder equal to an internal diameter of the suppressor inner housing wall, wherein the suppressor inner and outer housing walls are connected to the gas block cap by means of a lip fit mating into the first and second concentric shoulders, respectively.

7. The suppressor system as claimed in claim 1, comprising a suppressor mount assembly configured to attach to the barrel of the firearm, wherein the suppressor housing is affixed to the barrel in a concentric pattern about the bore of the barrel through the suppressor mount assembly.

8. The suppressor system as claimed in claim 7, wherein the series of transverse holes about the bore of the barrel connects the pressure chamber parallel to the bore of the barrel, wherein the gas block assembly is integrated into the suppressor mount assembly via the removable base cup.

9. The suppressor system as claimed in claim 1, wherein the removable base cup is located radially in a position by way of a locating pin and notch feature formed into the outer peripheral surface of the barrel, opposite the gas tube and just forward of a barrel chamber.

10. The suppressor system as claimed in claim 1, wherein the gas block cap is a pressure transfer cap.

11. The suppressor system as claimed in claim 1, wherein the pressure retainer is located towards the muzzle end of the barrel and concentric to an inner housing wall of the suppressor housing.

12. The suppressor system as claimed in claim 1, comprising a monocore baffle attached to the muzzle end of the barrel.

13. The suppressor system as claimed in claim 1, wherein the gas block cap is mechanically affixed to inner and outer housing walls of the suppressor housing as a structurally supportive feature.

14. The suppressor system as claimed in claim 1, wherein the shoulder is a smaller diameter concentric circular portion slightly fore and almost coplanar to a barrel nut and offset from a muzzle of the barrel.

15. The suppressor system as claimed in claim 1, wherein the gas block cap comprises a series of holes radially arrayed about a bore axis of the barrel and equidistant from each other.

* * * * *